US006134803A

United States Patent [19]

Gilchrist et al.

[11] Patent Number: 6,134,803

[45] Date of Patent: Oct. 24, 2000

[54] FLEXIBLE WOOD STICKER

[76] Inventors: Maurice H. Gilchrist, 105 Main St., Apt. #4, North Springfield, Vt. 05150; Peter W. Sheehan, 348 Stoughton Pond Rd., Perkinsville, Vt. 05151

[21] Appl. No.: 09/395,958

[22] Filed: Sep. 14, 1999

[51] Int. Cl.[7] ..... F26B 19/00

[52] U.S. Cl. ..... 34/94; 34/239

[58] Field of Search ..... 34/518, 396, 442, 34/77, 94, 92, 614, 201, 218, 236, 237, 239; 211/49.1, 59.4; 414/14, 789.5, 922; 248/560, 158, 160, 407, 174, 300, 346.01, 346.02; 108/52.1, 53.1, 91

[56] References Cited

U.S. PATENT DOCUMENTS

| | | | |
|---|---|---|---|
| 1,515,214 | 11/1924 | Kelleher et al. | 34/94 |
| 1,608,918 | 11/1926 | Alexander | 34/94 |
| 2,679,111 | 5/1954 | Leischner | 34/94 |
| 3,900,957 | 8/1975 | Denton et al. . | |
| 3,907,130 | 9/1975 | Hutcheson . | |
| 4,199,870 | 4/1980 | Arsenault . | |
| 4,788,777 | 12/1988 | Davis . | |
| 5,345,695 | 9/1994 | Graham . | |
| 5,704,134 | 1/1998 | Carter et al. | 34/396 |
| 5,813,137 | 9/1998 | Townsend | 34/518 |

OTHER PUBLICATIONS

Composite Kiln Stick, Hiram Forest Products, Ltd., 163 Grenadier Cres., Thornhill, Ontario, Canada L4J7V6.

*Primary Examiner*—Stephen Gravini
*Assistant Examiner*—Andrea M. Joyce
*Attorney, Agent, or Firm*—John J. Welch Jr, Esq.

[57] ABSTRACT

The instant device is an elongated four-sided, solid high molecular weight polyethylene wood sticker unit serving to separate, within a wood kiln unit, the lowermost surfaces of uppermost laid in planking from the uppermost surfaces of lowermost laid-in planking and characterized by the presence of four rounded edges marking the intersection of any two sides thereof and a helically inclined groove cut into the outer surfaces of all four sides thereof and extending uniformly from one end thereof to the other end thereof.

2 Claims, 4 Drawing Sheets

FLEXIBLE WOOD STICKER

CROSS REFERENCES TO PRIOR OR PARENT APPLICATIONS

There are no prior or parent applications in respect of the instant invention.

FEDERALLY SPONSORED RESEARCH AND DEVELOPMENT

There is no federally sponsored research and development in respect of the instant invention.

BACKGROUND OF THE INVENTION

1. Field of the Invention

The instant invention relates to those devices utilized to separate cut wood pieces one from another when stacked within a wood kiln unit.

2. Prior Art

The separately filed Informational Statement filed herewith sets forth references that however do not anticipate the instant invention.

A SUMMARY OF THE INVENTION

A Brief Description of the Invention

The instant invention is a uniformly thick solid, elongated, flexible, high molecular weight polyethylene wood sticker unit. The invention is characterized by the presence of four sides, four rounded edges each marking the edgewise intersection of two of the four sides thereof along the whole of the length of the wood sticker unit. A helically inclined groove is cut into the whole of the outer surface of the invention from one end thereof to the other.

Objects of the Invention

Freshly cut wood planking is placed in a kiln container so-called in order to permit such wood to dry out over time so as to ultimately be ready for sale. Problems with respect to utilization of sticker units currently in vogue for the purpose of separating units of such planking in such a kiln unit center about matters such as, for example, limitations on useful life stemming from rotting, molding, decay and/or breakage; inefficiently promoted intra-planking air flow for drying purposes; and non-exposeability of relatively significant portions of wood surface areas to airflow for drying purposes and concomitant moisture staining.

The instant invention addresses a resolution of all of these problems much better than any of the sticker units currently in vogue. Problems involving rotting, molding, decay, breakage and the like involve not insignificant replacement cost expense. The instant invention given its high molecular weight polyethylene essence is virtually wholly unbreakable. Also, rotting, susceptibility to mold and decay are non-concerns as they are with respect to the various sticker variants currently in vogue that are themselves made out of wood in virtually all instances. Moreover, the streaky surface staining of kiln held planking along the lineages of any of the currently in vogue sticker units causes waste of planking. But, the rounded corners of the instant invention markedly minimize any such sticker-planking surface area apposition to the fullest possible extent thereby minimizing greatly such planking waste due to non-dryable surface moisture staining. The drying rate of kiln held planking due to airflow between planking is also maximized by virtue of such rounded cornering that maximizes intra-planking air flow. Also, load carrying capacity of stickers is greatly enhanced due to the high molecular weight polyethylene makeup of the instant invention. Finally, the symmetry of all four sides of the instant invention makes it readily possible for the instantly invented stickers to be placed mechanically into a kiln between planking rather than manually as respects currently in vogue stickers thereby greatly enhancing the rapid and relatively inexpensive construction of a kiln held batch of planking to be so dried for ultimate sale to others.

In conclusion, in view of the foregoing, it is respectfully submitted that the instant invention is not merely new, useful and unique but is rather indeed virtually revolutionary within the field involving sticker units serving to facilitate the drying of kiln held wood planking units.

A BRIEF DESCRIPTION OF THE DRAWINGS

A DESCRIPTION OF THE PREFERRED EMBODIMENT

Figure 1:
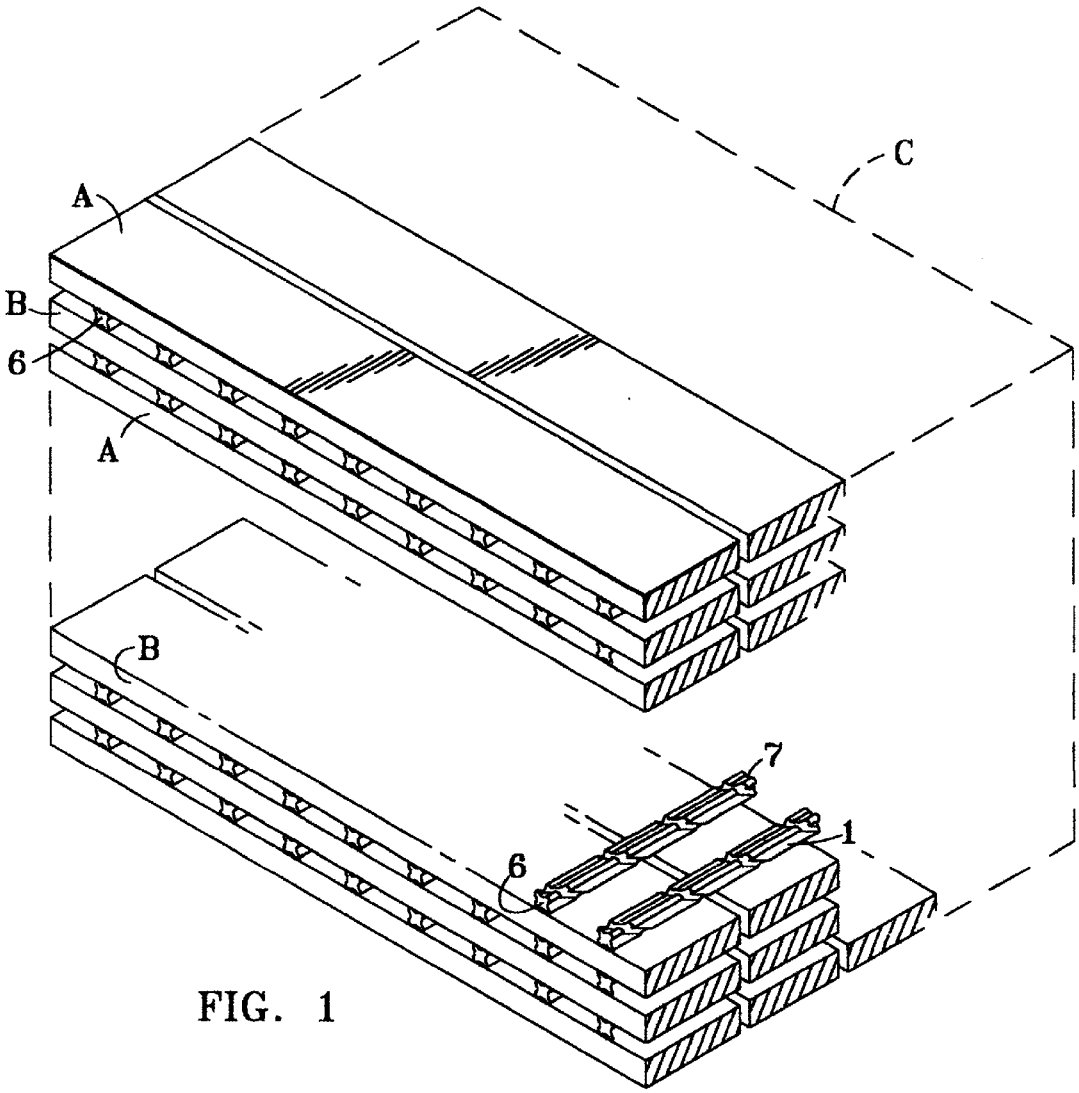
FIG. 1 is a broken perspective view of a kiln of wood planking units separated by various equivalent embodiments of the instant invention.
Figure 2:
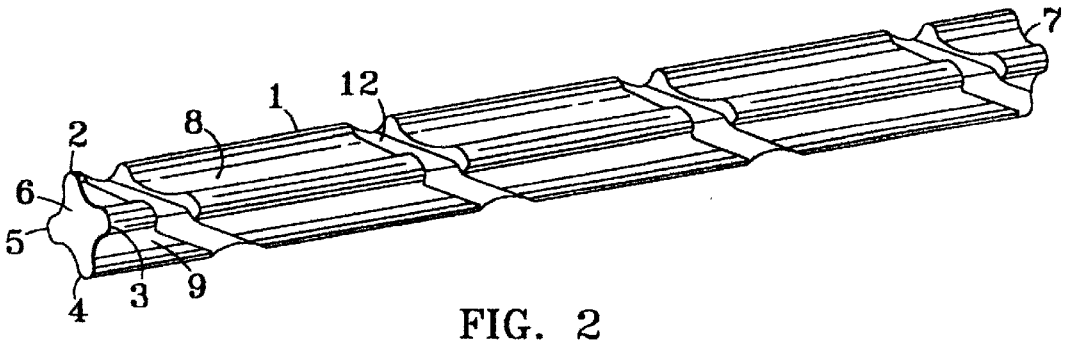
FIG. 2 is an isolated perspective view of the intact instant invention.
Figure 3:
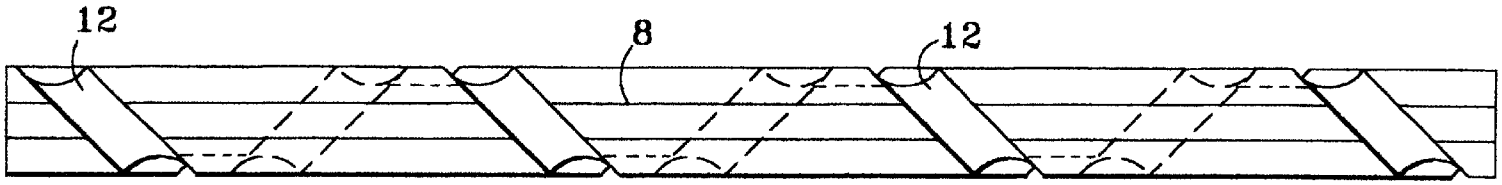
FIG. 3 is a plan view of a portion of the instant invention.
Figure 4:
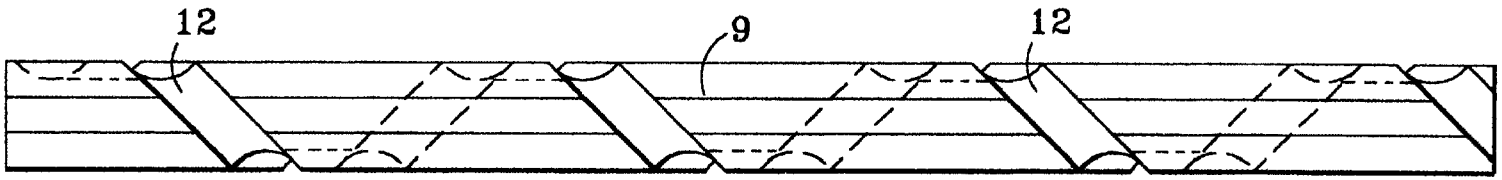
FIG. 4 is a plan view of what is seen in FIG. 3 but rotated through an angle of 90°.
Figure 5:
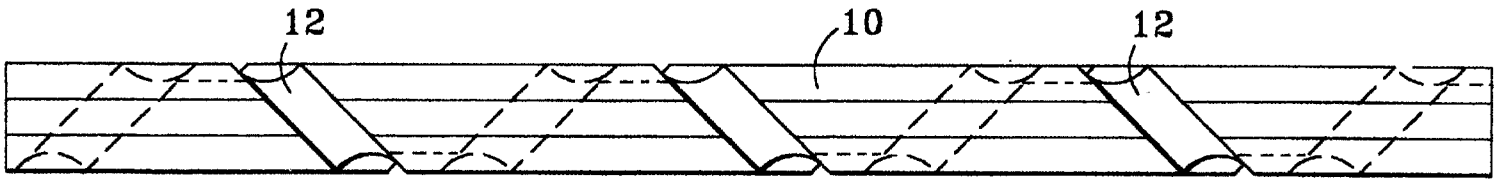
FIG. 5 is a plan view of what is seen in FIG. 3 but rotated through an angle of 180°.
Figure 6:
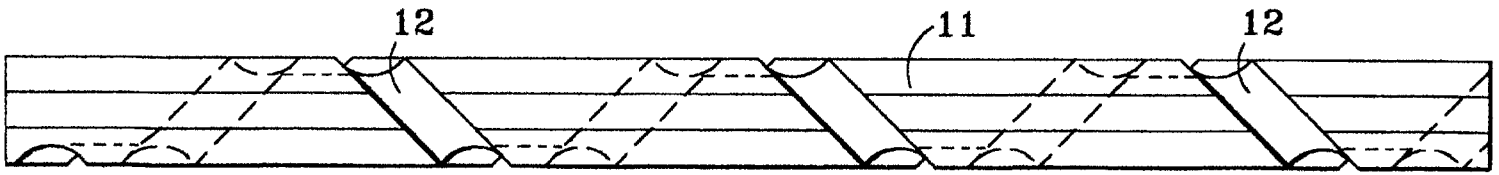
FIG. 6 is a plan view of what is seen in FIG. 3 but rotated through an angle of 270°.
Figure 7:
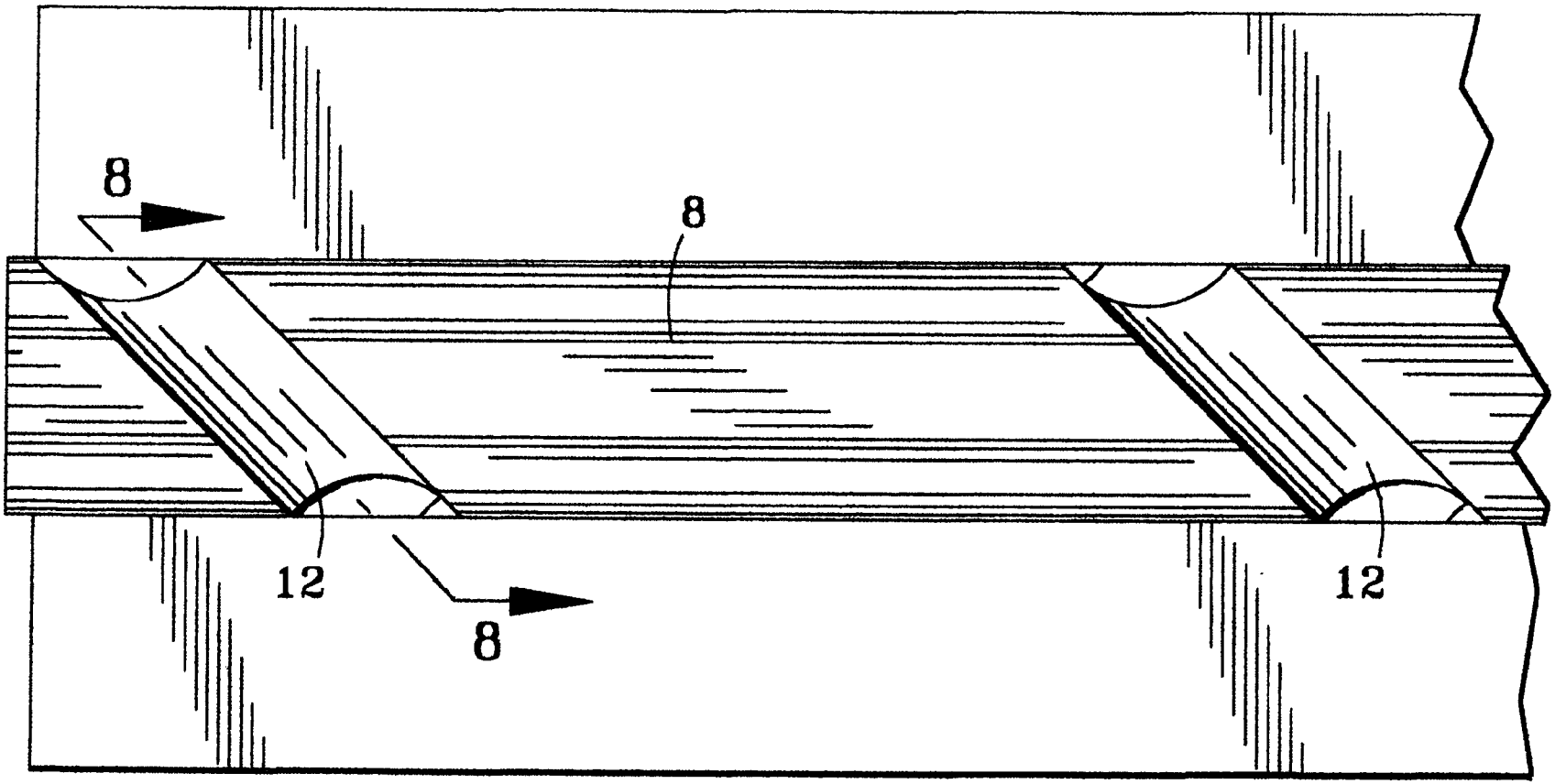
FIG. 7 is a close up plan view illustrating the uniformly continuous cut and helically inclined grooving within the outer surfaces of the instant invention.
Figure 8:
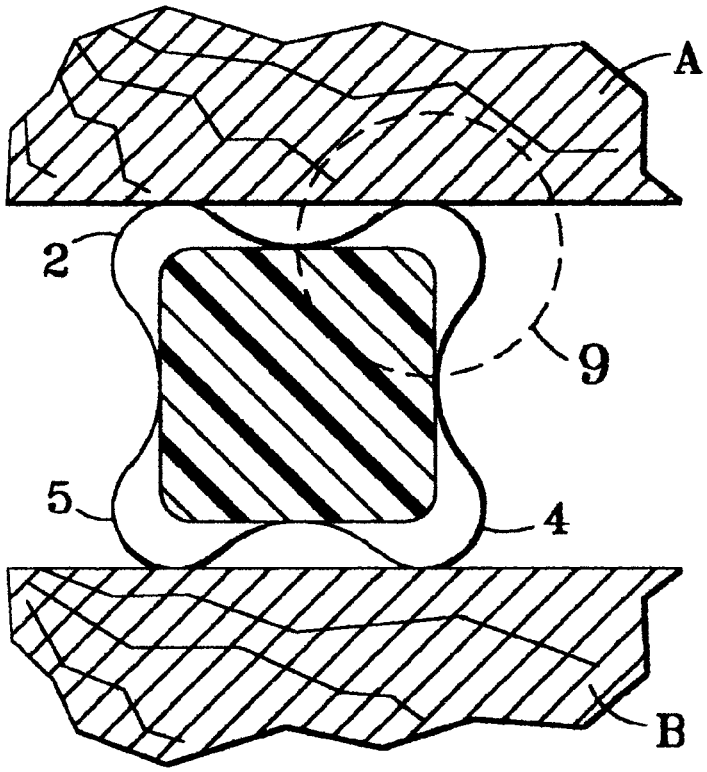
FIG. 8 is an on-end cross sectional view of the instant invention.
Figure 9:
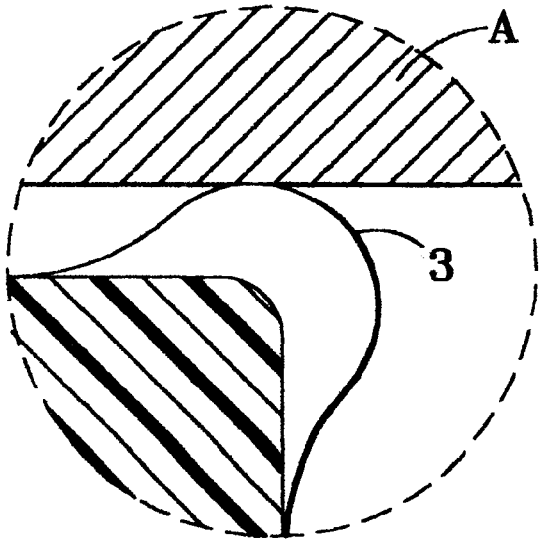
FIG. 9 is a close up cross sectional view of one of the rounded edge features of the instant invention.

FIG. 1 is a broken perspective view of a stack of wood planking as it would be held within a wood kiln unit in contemplation of a drying of the wood in the presence of air or pressurized air in order to cause evaporation of moisture within such planking as would have been freshly cut. Planking A is uppermost planking separated in respect of a lowermost surface thereof by flexible wood sticker units; embodiments of the instant invention within the kiln unit from the uppermost surface of lowermost planking B. FIG. 2 is an isolated perspective view of one of the equivalent embodiments of the instant invention illustrated as being present in FIG. 1. Flexible wood sticker unit 1 is characterized by the presence of four equivalent symmetrically shaped sides 8, 9, 10 and 11 as can be noted with reference to FIGS. 2, 3, 4, 4 and 6. Unit 1 also has a first end 6 and a second end 7 as well as rounded edges 2, 3, 4 and 5 each of which marks an intersection of two of the four sides 8, 9, 10 and 11 as are all to be noted with reference to FIGS. 2, 3, 4, 5 and 6 as well. FIG. 7 is a close up plan view illustrating a portion of uniformly and continuously cut helically inclined grooving 12 so cut into the outer surfaces of each of equivalent sides 8, 9, 10 and 11 of unit 1. FIG. 8 is an one end cross sectional view of unit 1 serving to demonstrate the manner in which it serves to separate the lowermost surfaces of planking A within a kiln unit from the uppermost surfaces of planking B within such a kiln unit. FIG. 9 is a close up cross sectional view of rounded edge 3 of unit 1.

The instant invention was conceived out of a concern that sticker units currently in vogue had unacceptably short useful lives in view of a propensity of rotting, decay, the effects of mold and simple breakage in the face of simple inter-kiln load bearing on repeated occasions. Also, of concern was a perceived need to discern how to perhaps insert stickers into a progressively built-up planking pile within a kiln unit, mechanically rather than by hand on the part of at least a pair of individuals placing stickers on plank units B in anticipation of separating them from plank units A placed within a kiln for drying. Also, of concern, as well was the matter of relatively expensive scrapping of various planking units A or B separated by current state of the art stickers within kiln units that were invariably suffering an undesirable amount of water staining or sticker marks so-called resulting from insufficient aeration and drying of significant portions of planking A and B in view of too much surface area being isolated from aeration on account of the mere presence of the sticker units themselves. Faster and more uniformly processed drying of planking A and B were moreover concerns as well.

In response to all of these concerns, there was the evolved notion that a sticker of polyethylene essence would obviate concerns related to rot, mold and decay. Moreover, it was discerned that a high molecular weight polyethylene sticker would and indeed has proven eminently more durable in the face of load bearing concerns. Consequently, greater load bearing and the construction of large kiln units is now possible by virtue of the fact of the existence of the instant invention. More freshly cut planking A and B is now able to be dried per unit time with resort to use of the instant invention 1 than with resort to use of other stickers currently in vogue. The instant sticker unit 1 moreover, as noted above has four equivalent symmetrically shaped sides 8, 9, 10 and 11 all of which are suitable for placement against the surfaces of planking A and B as contrasted with stickers currently in vogue that prototypically have only two sides amendable to placement against surfaces of planking A and B. Consequently, the instant invention can readily be placed mechanically as between planking A and B rather than having to be placed there between by hand as is the case with respect to stickers currently in vogue. This feature of the instant invention renders it extremely useful from a standpoint of facilitating a quick and ready stacking of planking A and B within a kiln unit C much moreso than with other stickers currently in vogue. Also, the four rounded edges 2, 3, 4 and 5 of unit 1 serve to greatly minimize sticker surface apposition to the surfaces of planking A and B, and, the strength and durability of polyethylene makeup of unit 1 serves to guarantee load bearing or edging without deformation. Hence, only a minimum of amount of surface area of planking A or B is sticker isolated from the flow of air through kiln unit C holding planking A and B such that any propensity for sticker staining and resultant undesirable moisture retention in planking A or B is markedly minimized. Such minimalized sticker-plank surface isolation from the flow of drying air moreover makes for faster and more uniformly processed drying and concomitant stain diminution especially in conjunction with the air flow functioning of helical grooving 12 as well.

In conclusion, respectfully submitted, as earlier stated, the instant invention in view of its particularly unique combination of new features as noted above is indeed revolutionary in the art and field of wood sticker devices.

What is claimed is:

1. A flexible solid wood sticker for separating the lowermost surfaces of uppermost planking stacked within a wood kiln unit from the uppermost surfaces of lowermost planking therein stacked, comprising:

a. an elongated four-sided unit;

b. four rounded edges each marking an intersection of any two sides of said four-sided unit;

c. each of said rounded edges extending from a first end of said elongated four-sided unit to a second end of said elongated four-sided unit;

d. a helically inclined grooving uniformly cut into outer surfaces of each of said rounded edges and of each of said sides of said four-sided unit and extending from said first end thereof said second thereof, and;

e. said flexible wood sticker being made up uniformly throughout of a polyethylene material.

2. A flexible solid wood sticker for separating the lowermost surfaces of uppermost planking stacked within a wood kiln unit from the uppermost surfaces of lowermost planking therein stacked, comprising:

a. an elongated four-sided unit;

b. four rounded edges each marking an intersection of any two sides of said four-sided unit;

c. each of said rounded edges extending from a first end of said elongated four-sided unit to a second end of said elongated four-sided unit;

d. a helically inclined grooving uniformly cut into outer surfaces of each of said rounded edges and of each of said sides of said four-sided unit and extending from said first end thereof to said second thereof, and;

e. said flexible wood sticker being made up uniformly throughout of a high molecular weight polyethylene material.

* * * * *